US012709888B2

(12) United States Patent
Kaneyasu et al.

(10) Patent No.: US 12,709,888 B2
(45) Date of Patent: Aug. 18, 2026

(54) ANCHOR SUPPORT AND ANCHOR INSTALLATION METHOD

(71) Applicant: Sekisui House, Ltd., Osaka (JP)

(72) Inventors: Kentarou Kaneyasu, Osaka (JP); Yoshiyuki Matsubara, Osaka (JP); Takeshi Takagi, Osaka (JP); Kazuki Ichikawa, Osaka (JP); Toshiyuki Osada, Osaka (JP); Yukiko Ichikawa, Osaka (JP); Sachi Okamoto, Osaka (JP)

(73) Assignee: Sekisui House, Ltd., Osaka (JP)

( * ) Notice: Subject to any disclaimer, the term of this patent is extended or adjusted under 35 U.S.C. 154(b) by 182 days.

(21) Appl. No.: 18/842,188

(22) PCT Filed: Aug. 21, 2023

(86) PCT No.: PCT/JP2023/030064
§ 371 (c)(1),
(2) Date: Aug. 28, 2024

(87) PCT Pub. No.: WO2025/041242
PCT Pub. Date: Feb. 27, 2025

(65) Prior Publication Data
US 2026/0176863 A1 Jun. 25, 2026

(51) Int. Cl.
*E04B 1/41* (2006.01)

(52) U.S. Cl.
CPC ..... *E04B 1/4157* (2013.01)

(58) Field of Classification Search
CPC ..... E04B 1/4157
USPC ..... 52/745.21
See application file for complete search history.

(56) References Cited

U.S. PATENT DOCUMENTS 3,458,184 A * 7/1969 Schlosser ..... E04B 1/0007 249/207
4,202,149 A * 5/1980 Betrue, Sr. ..... E04B 1/0007 52/713
4,412,407 A * 11/1983 Melfi ..... E04G 21/185 52/309.1

(Continued)

FOREIGN PATENT DOCUMENTS

JP S58-179357 U 11/1983
JP S60-36428 U 3/1985

(Continued)

*Primary Examiner* — Basil S Katcheves
(74) *Attorney, Agent, or Firm* — Wolf, Greenfield & Sacks, P.C.

(57) ABSTRACT

An anchor support includes a formwork attachment portion, an anchor support portion, and an adjustment portion. The adjustment portion includes an attachment member, a first adjustment member, and a second adjustment member. The attachment member is inserted into an attachment hole of the formwork attachment portion and is engaged with a formwork so as to attach the formwork attachment portion to an outer surface of the formwork. The first adjustment member is disposed between the outer surface of the formwork and a back surface of the formwork attachment portion. The second adjustment member protrudes from the back surface of the formwork attachment portion toward the formwork, and engages with an adjustment hole of the formwork attachment portion to be able to adjust a protrusion amount toward the formwork.

6 Claims, 5 Drawing Sheets

(56) References Cited

U.S. PATENT DOCUMENTS

| | | | | |
|---|---|---|---|---|
| 5,337,534 | A * | 8/1994 | Nasca | E04G 21/185 52/699 |
| 5,670,076 | A * | 9/1997 | Leek | E04G 21/185 52/700 |
| 5,836,132 | A * | 11/1998 | Weathersby | E04G 21/185 249/207 |
| 6,065,730 | A | 5/2000 | Marks et al. | |
| 6,508,447 | B1 * | 1/2003 | Catani | E04C 5/18 248/65 |
| 6,591,574 | B2 | 7/2003 | Humphrey | |
| 6,922,968 | B1 * | 8/2005 | Behlen | E04G 21/185 52/700 |
| 7,445,192 | B2 * | 11/2008 | Gridley | E04B 1/4157 249/207 |
| 8,484,917 | B2 * | 7/2013 | McClain | E04B 1/41 52/712 |
| 8,522,507 | B2 * | 9/2013 | Asada | E04G 17/12 52/251 |
| 2008/0265128 | A1 * | 10/2008 | Hughes | E04G 21/185 249/190 |
| 2014/0157699 | A1 * | 6/2014 | Moeller | E04B 2/88 52/235 |
| 2021/0172183 | A1 * | 6/2021 | Brunson | E04B 1/4157 |
| 2024/0247457 | A1 | 7/2024 | Kaneyasu et al. | |

FOREIGN PATENT DOCUMENTS

| | | | |
|---|---|---|---|
| JP | H04-228724 | A | 8/1992 |
| JP | 2003-138574 | A | 5/2003 |
| JP | 3236725 | U | 3/2022 |
| WO | WO 2022/254532 | A1 | 12/2022 |

* cited by examiner

ANCHOR SUPPORT AND ANCHOR INSTALLATION METHOD

CROSS REFERENCE TO RELATED APPLICATIONS

This Application is a national stage filing under 35 U.S.C. 371 of International Patent Application Serial No. PCT/JP2023/030064 filed Aug. 21, 2023, entitled "ANCHOR SUPPORT AND ANCHOR INSTALLATION METHOD." The entire content of this application is incorporated herein by reference in its entirety.

TECHNICAL FIELD

The present disclosure relates to an anchor support and an anchor installation method.

BACKGROUND ART

A foundation of a building may be provided with anchors. In Patent Literature 1, during construction of the foundation, anchor supports that support the anchors are attached to a formwork of the foundation.

CITATION LIST

Patent Literature

Patent Literature 1: International Publication No. 2022/254532

SUMMARY OF INVENTION

Technical Problem

A formwork is installed along a reference line of a foundation. Anchors are disposed so as to be along the reference line by attaching the anchors to anchor supports installed on the formwork. In order to dispose the anchors precisely along the reference line, the positions of the anchor supports in the formwork are adjusted. In order to improve work efficiency, it is desirable that the positions of the anchor supports with respect to the formwork be easily adjusted.

Solution to Problem (1) To achieve the foregoing objective, an anchor support supports an anchor provided in a foundation. The anchor support includes a formwork attachment portion attached to an outer surface of a formwork of the foundation, an anchor support portion extending from the formwork attachment portion and supporting the anchor, and an adjustment portion that adjusts at least one of a first angle in a vertical direction and a second angle in a horizontal direction of the anchor support portion with respect to the formwork. The formwork attachment portion includes an attachment hole and an adjustment hole. The adjustment portion includes an attachment member inserted into the attachment hole of the formwork attachment portion and engaged with the formwork to attach the formwork attachment portion to the outer surface of the formwork, a first adjustment member disposed between the outer surface of the formwork and a back surface of the formwork attachment portion, and a second adjustment member protruding from the back surface of the formwork attachment portion toward the formwork, and engaging with the adjustment hole of the formwork attachment portion to be able to adjust a protrusion amount toward the formwork. According to this configuration, by adjusting an insertion amount of the first adjustment member, an insertion amount of the first adjustment member with respect to the formwork can be adjusted. The first angle and the second angle of the anchor support with respect to the formwork can be adjusted by adjusting the thickness of the portion of the first adjustment member located between the outer surface of the formwork and the back surface of the formwork attachment portion. In addition, by adjusting the protrusion amount of the second adjustment member with respect to the formwork, the first angle and the second angle of the anchor support with respect to the formwork can be adjusted. In this way, the position of the anchor support with respect to the formwork can be easily adjusted.

(2) In the anchor support of the above item (1), the first adjustment member includes an inclined surface inclined such that a thickness of the first adjustment member increases in a direction along the outer surface of the formwork, or multiple stepped surfaces in which the thickness of the first adjustment member increases in a direction along the outer surface of the formwork. According to this configuration, the thickness of the portion of the first adjustment member disposed between the outer surface of the formwork and the back surface of the formwork attachment portion can be suitably adjusted.

(3) In the anchor support of the above item (1) or (2), the adjustment hole includes a first adjustment hole, a second adjustment hole, and a third adjustment hole. The adjustment portion includes three second adjustment member disposed in the first adjustment hole, the second adjustment hole, and the third adjustment hole, respectively. The first adjustment hole is disposed above the second adjustment hole or the third adjustment hole in the vertical direction. The first adjustment hole is disposed at a position away from the second adjustment hole or the third adjustment hole in the horizontal direction. According to this configuration, by adjusting the protrusion amount of each of the three second adjustment members, the angle of the formwork attachment portion with respect to the formwork can be suitably adjusted. By adjusting the angle of the formwork attachment portion, the angle of the anchor support with respect to the formwork can be adjusted.

(4) The anchor support of any one of the above items (1) to (3) includes a main body support portion provided on a lower surface of the anchor support portion to support the anchor support portion. The main body support portion is disposed on an upper surface of the formwork. According to this configuration, since the anchor support portion is supported on the upper surface of the formwork by the main body support portion, the anchor is suitably supported with respect to the formwork.

(5) The anchor support of any one of the above items (1) to (4), the formwork attachment portion includes an attachment plate-shaped member disposed to extend in the vertical direction along the formwork. The anchor support portion includes an anchor support plate-shaped member intersecting the attachment plate-shaped member. The anchor support plate-shaped member is formed integrally with the attachment plate-shaped member. In a case in which the attachment plate-shaped member is formed separately from the anchor support plate-shaped member, foreign matter such as soil or concrete enters between the attachment plate-shaped member and the anchor support plate-shaped member, and thus, positional accuracy may decrease. According to this configuration, since the attachment plate-shaped member is formed integrally with the anchor support plate-shaped member, the anchor support is easily handled.

(6) To achieve the fore going objective, an anchor installation method of installing an anchor in a formwork by using an anchor support is provided. The anchor support includes a formwork attachment portion attached to an outer surface of the formwork of a foundation and an anchor support portion that supports the anchor. The anchor installation method includes: a first step of attaching the formwork attachment portion to the outer surface of the formwork by an attachment member such that a gap is provided between the outer surface of the formwork and a back surface of the formwork attachment portion; a second step of disposing a first adjustment member in the gap; and a third step of adjusting an angle of the anchor support portion with respect to the formwork by protruding a second adjustment member from the back surface of the formwork attachment portion toward the formwork, the second adjustment member being engaged with an adjustment hole provided in the formwork attachment portion, and by adjusting a protrusion amount toward the formwork. According to this configuration, since the angle of the anchor support with respect to the formwork can be suitably adjusted by the first adjustment member and the second adjustment member, the position of the anchor support with respect to the formwork can be easily adjusted.

Advantageous Effects of Invention

An anchor support and an anchor installation method of the present disclosure allow the position of an anchor support with respect to a formwork to be adjusted easily.

DESCRIPTION OF EMBODIMENTS

Embodiment

Figure 1:
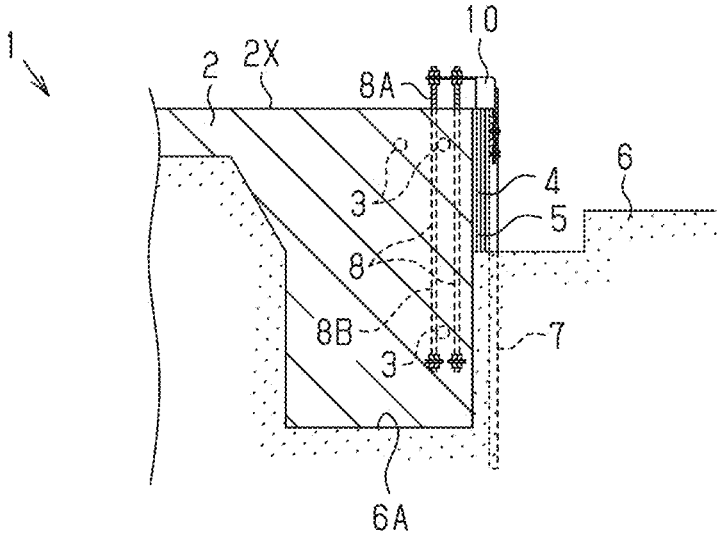
FIG. 1 is a schematic view of a foundation in which an anchor support according to an embodiment is used.

An anchor support 10 and an anchor installation method according to the present embodiment will now be described with reference to FIGS. 1 to 8. The anchor support 10 is used during construction of a foundation 1. An example of the foundation 1 to which the anchor support 10 is applied is not limited. Examples of the foundation 1 include a mat foundation. FIG. 1 illustrates a case in which the foundation 1 is the mat foundation.

As illustrated in FIG. 1, the foundation 1 includes concrete 2 and reinforcing bars 3. The foundation 1 is formed by placing the concrete 2 in a formwork 4. In the case of the mat foundation, the formwork 4 includes a frame plate 5. The frame plate 5 is installed so as to surround the outer periphery of the foundation 1 to be constructed. The frame plate 5 is supported on a ground 6 by a support rod 7.

The foundation 1 is provided with anchors 8. Each anchor 8 is provided such that a part of the anchor 8 is exposed from the foundation 1. A portion 8B other than an exposed portion 8A of each anchor 8 is buried in the concrete 2 forming the foundation 1. The exposed portion 8A of each anchor 8 is coupled to a column of a building main body erected on the foundation 1. In one example, the anchors 8 are installed along the outer periphery of the foundation 1.

The anchor support 10 illustrated in the present embodiment can be suitably used for the mat foundation. When the foundation 1 is a continuous footing, the formwork 4 corresponding to the rising part of the continuous footing includes two frame plates 5 installed parallel to each other. Therefore, the anchors 8 disposed between the two frame plates 5 can be supported by a support member supported by the two frame plates 5. On the other hand, when the foundation 1 is the mat foundation as illustrated in FIG. 1, the frame plate 5 is installed so as to surround the outer periphery of the foundation 1. Therefore, the anchor support 10 that supports the anchors 8 is fixed to the frame plate 5 in a cantilever state. In the case in which the anchor support is supported by the frame plate 5 in the cantilever state as described above, the anchor support 10 of the present embodiment can be suitably used.

Anchor Support

As illustrated in FIG. 1, the anchor support 10 is a jig for installing the anchors 8 in the foundation 1. Multiple the anchor supports 10 may be used for the foundation 1. The anchor support 10 supports the anchors 8 provided in the foundation 1. The anchor support 10 is used in construction of the foundation 1 at a stage at which the anchors 8 are installed in the foundation 1 after the formwork 4 of the foundation 1 is installed and before the concrete 2 is placed in the formwork 4.

Figure 2:
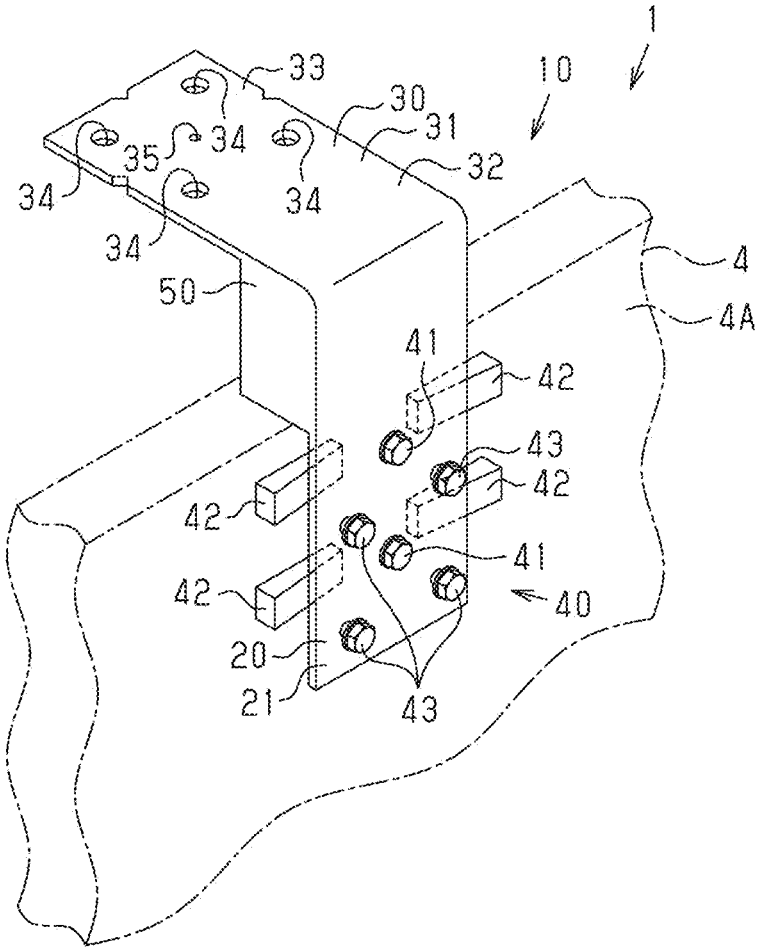
FIG. 2 is a perspective view of the anchor support according to the embodiment.

As illustrated in FIG. 2, the anchor support 10 includes a formwork attachment portion 20, an anchor support portion 30, and an adjustment portion 40. The formwork attachment portion 20 and the anchor support portion 30 are made of, for example, metal.

Formwork Attachment Portion

Figure 3:
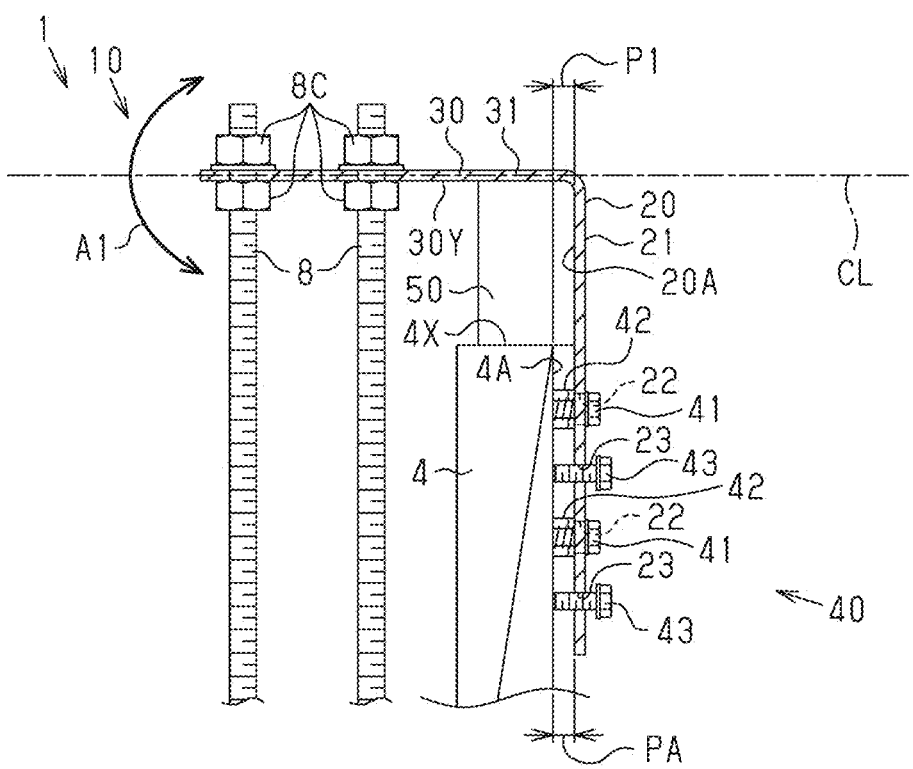
FIG. 3 is a cross-sectional view of a state in which the anchor support of the embodiment is installed on a formwork.

As illustrated in FIGS. 2 and 3, the formwork attachment portion 20 is attached to an outer surface 4A of the formwork 4 of the foundation 1. The anchor support 10 is fixed to the formwork 4 by attaching the formwork attachment portion 20 to the outer surface 4A of the formwork 4. The formwork attachment portion 20 includes an attachment plate-shaped member 21. The attachment plate-shaped member 21 is disposed so as to extend in the vertical direction along the formwork 4 in a state in which the anchor support 10 is installed on the formwork 4. The attachment plate-shaped member 21 is disposed such that a back surface 20A of the attachment plate-shaped member 21 is not in contact with the outer surface 4A of the formwork 4 in a state in which the anchor support 10 is installed on the formwork 4. The back surface 20A of the attachment plate-shaped member 21 is a surface of the attachment plate-shaped member 21 facing the formwork 4 in a state in which the anchor support 10 is installed on the formwork 4.

Figure 4:
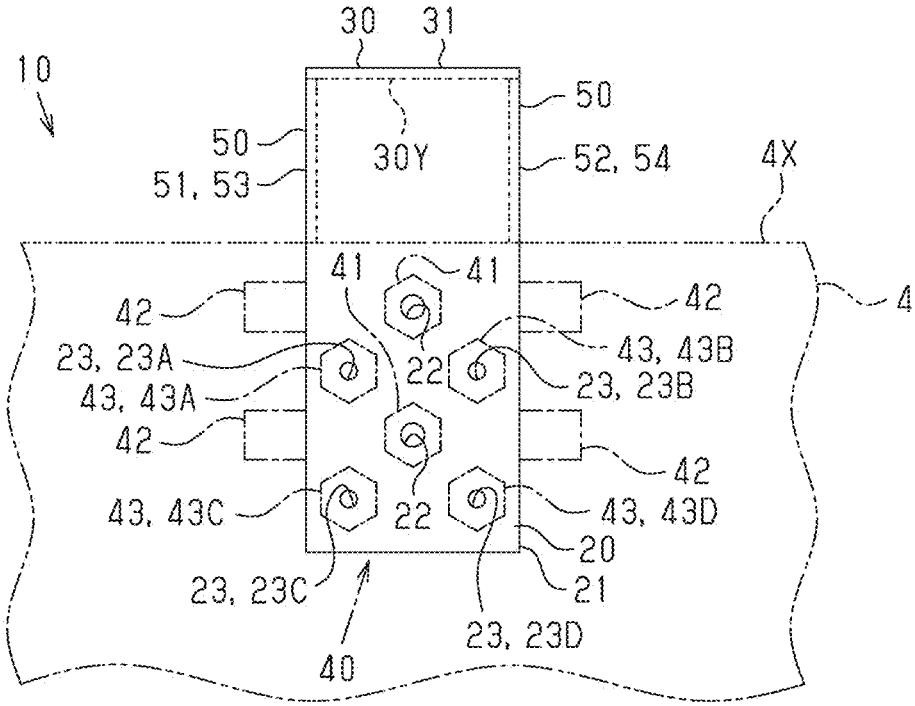
FIG. 4 is a front view of the anchor support according to the embodiment.

In FIG. 4, attachment members 41, first adjustment members 42, and second adjustment members 43 of the adjustment portion 40 are indicated by long-dash short-dash lines. As illustrated in FIG. 4, the formwork attachment portion 20 includes attachment holes 22 and adjustment holes 23. The attachment holes 22 and the adjustment holes 23 are formed in the attachment plate-shaped member 21. The attachment holes 22 are round holes. An internal thread is formed on an inner surface of each adjustment hole 23.

In the present embodiment, two attachment holes 22 are formed in the attachment plate-shaped member 21. The two attachment holes 22 are disposed side by side in the vertical direction. The two attachment holes 22 are disposed near a center of the attachment plate-shaped member 21 in the horizontal direction.

The adjustment holes 23 include a first adjustment hole 23A, a second adjustment hole 23B, and a third adjustment hole 23C. The adjustment holes 23 of the present embodiment include a fourth adjustment hole 23D. The first adjustment hole 23A, the second adjustment hole 23B, the third adjustment hole 23C, and the fourth adjustment hole 23D are disposed in the attachment plate-shaped member 21 so as to form a rectangle. The first adjustment hole 23A, the second adjustment hole 23B, the third adjustment hole 23C, and the fourth adjustment hole 23D may be disposed in the attachment plate-shaped member 21 so as to form a square.

The first adjustment hole 23A is disposed above the second adjustment hole 23B or the third adjustment hole 23C in the vertical direction. In the present embodiment, the first adjustment hole 23A is disposed above the third adjustment hole 23C in the vertical direction. The second adjustment hole 23B is disposed at the same position as the first adjustment hole 23A in the vertical direction. The fourth adjustment hole 23D is disposed at the same position as the third adjustment hole 23C in the vertical direction.

The first adjustment hole 23A is disposed at a position away from the second adjustment hole 23B or the third adjustment hole 23C in the horizontal direction. In the present embodiment, the first adjustment hole 23A is disposed at a position away from the second adjustment hole 23B in the horizontal direction. The third adjustment hole 23C is disposed at the same position as the first adjustment hole 23A in the horizontal direction. The fourth adjustment hole 23D is disposed at the same position as the second adjustment hole 23B in the horizontal direction.

Anchor Support Portion

As illustrated in FIGS. 2 and 3, the anchor support portion 30 extends from the formwork attachment portion 20. The anchor support portion 30 supports the anchors 8. The anchor support portion 30 includes an anchor support plate-shaped member 31. The anchor support plate-shaped member 31 intersects the attachment plate-shaped member 21. The anchor support plate-shaped member 31 extends along the upper surface 4X of the formwork 4 in a state in which the anchor support 10 is installed on the formwork 4.

In the present embodiment, the anchor support portion 30 is formed integrally with the formwork attachment portion 20 and a main body support portion 50. The anchor support plate-shaped member 31 is formed integrally with the attachment plate-shaped member 21. The anchor support plate-shaped member 31 and the attachment plate-shaped member 21 are formed by bending a single plate. The anchor support plate-shaped member 31 and the attachment plate-shaped member 21 may be welded, so that the anchor support portion 30 is formed integrally with the formwork attachment portion 20.

The anchor support portion 30 includes a base portion 32 and an anchor attachment portion 33. The base portion 32 is connected to the formwork attachment portion 20. The base portion 32 is provided near an end portion of the anchor support plate-shaped member 31 located on the side closer to the attachment plate-shaped member 21. The base portion 32 includes a portion of the anchor support plate-shaped member 31 connected to the attachment plate-shaped member 21.

The anchor attachment portion 33 is provided at an end portion of the anchor support plate-shaped member 31 opposite to the base portion 32. The anchors 8 are attached to the anchor attachment portion 33. The anchor attachment portion 33 is provided with anchor holes 34 through which the anchors 8 can be inserted. For example, the anchor support portion 30 is provided with four anchor holes 34. The four anchor holes 34 are disposed such that a shape formed by the four anchor holes 34 is a square. In the example in FIG. 5, the anchors 8 are disposed in each of two anchor holes 34 located on a diagonal line among the four anchor holes 34. The anchors 8 disposed in the anchor holes 34 are fastened to the anchor support plate-shaped member 31 by nuts 8C.

The anchor attachment portion 33 is provided with an anchor reference portion 35. The four anchor holes 34 are disposed at positions, respectively, equidistant from the anchor reference portion 35. The anchor reference portion 35 is used as a mark indicating a reference position of the anchor support portion 30. The anchor reference portion 35 is used to adjust the position of the anchor support 10 before the anchor support 10 is fixed to the formwork 4.

Figure 5:
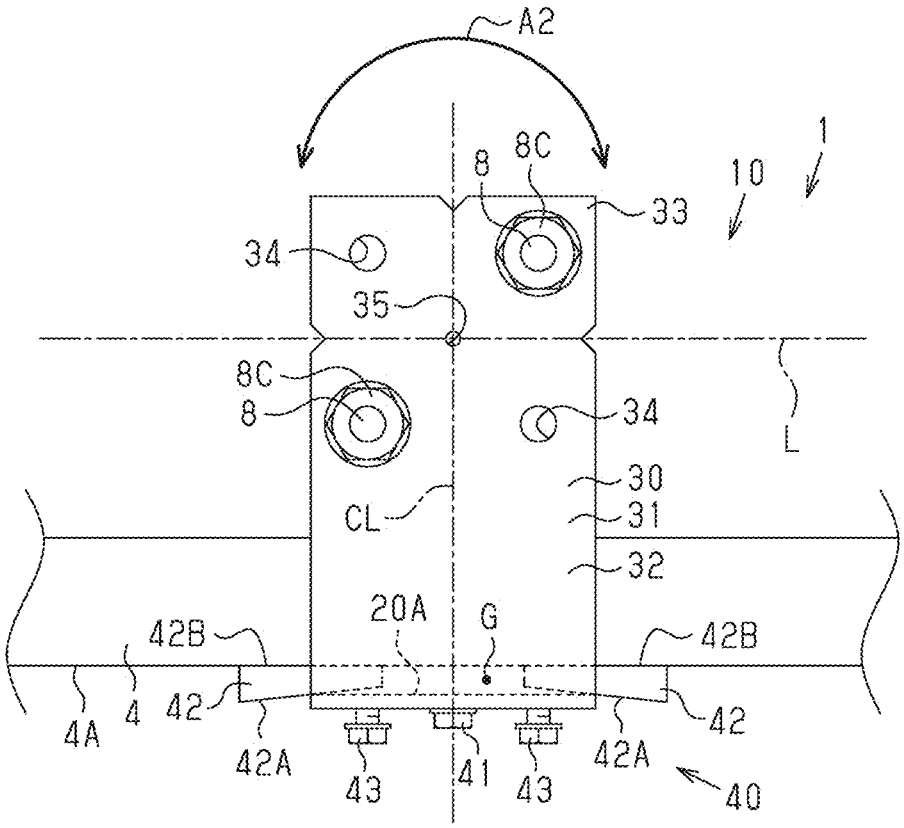
FIG. 5 is a plan view of a state in which the anchor support of the embodiment is installed on the formwork.

As illustrated in FIG. 5, the anchor reference portion 35 is used as a reference position of the anchor support portion 30 when checking a positional deviation between a reference line L established with respect to the foundation 1 and the anchor support portion 30. The reference line L is, for example, a leveling string or a scribed line. In the present embodiment, the anchor reference portion 35 is configured as a hole extending through the anchor support plate-shaped member 31. When the anchor reference portion 35 is a hole extending through the anchor support plate-shaped member 31, the reference line L can be checked through the hole from above the anchor support portion 30. The anchor reference portion 35 may be configured as a recess or an imprint mark. The anchors 8 can be installed in alignment with the reference line L by the anchor reference portion 35.

The anchors 8 are attached to the anchor support portion 30 of the anchor support 10 disposed at the predetermined position. The anchors 8 inserted into the anchor holes 34 of the anchor attachment portion 33 are fixed to the anchor support portion 30 by the nuts 8C. Since the anchor support 10 is disposed at the predetermined position with respect to the foundation 1, the anchors 8 can be disposed at predetermined positions of the foundation 1 only by inserting the anchors 8 into the anchor support portion 30.

Adjustment Portion

As illustrated in FIGS. 3 to 5, the adjustment portion 40 adjusts at least one of the first angle and the second angle of the anchor support portion 30 with respect to the formwork 4. In the present embodiment, the adjustment portion 40 adjusts both the first angle and the second angle of the anchor support portion 30 with respect to the formwork 4. The adjustment portion 40 further adjusts an insertion amount of the anchor support portion 30 with respect to the formwork 4. The insertion amount indicates a position of the back surface 20A of the formwork attachment portion 20 with respect to the outer surface 4A of the formwork 4. The insertion amount is defined by, for example, a distance P1 from the outer surface 4A of the formwork 4 to the back surface 20A of the formwork attachment portion 20.

The first angle is an angle of the anchor support portion 30 with respect to the formwork 4 in the vertical direction. The first angle is an angle formed by the upper surface 4X of the formwork 4 and a center line CL of the anchor support plate-shaped member 31. As illustrated in FIG. 3, the first angle is an angle in a first direction A1 in the vertical direction. The second angle is an angle of the anchor support portion 30 with respect to the formwork 4 in the horizontal direction. The second angle is an angle formed by, for example, the outer surface 4A of the formwork 4 and the center line CL of the anchor support plate-shaped member 31 in plan view. As illustrated in FIG. 5, the second angle is an angle in a second direction A2 in the horizontal direction. The center line CL of the anchor support plate-shaped member 31 is a line passing through the center of the anchor support plate-shaped member 31. In plan view, the center line CL of the anchor support plate-shaped member 31 passes through the anchor reference portion 35. The center line CL of the anchor support plate-shaped member 31 extends so as to intersect the outer surface 4A of the formwork 4 in plan view.

As illustrated in FIGS. 2 and 3, the adjustment portion 40 includes the attachment members 41, the first adjustment members 42, and the second adjustment members 43. The attachment members 41 are inserted into the attachment holes 22 of the formwork attachment portion 20 and are engaged with the formwork 4 so as to attach the formwork attachment portion 20 to the outer surface 4A of the formwork 4. The attachment members 41 are, for example, screws. The screws of the attachment members 41 may be full screws or half screws. The attachment members 41 are engaged with the formwork 4 by screwing the screws of the attachment members 41 into the frame plate 5 of the formwork 4. The attachment members 41 are not engaged with the attachment plate-shaped member 21 of the formwork attachment portion 20. Since the attachment members 41 are not engaged with the attachment plate-shaped member 21 of the formwork attachment portion 20, the attachment plate-shaped member 21 can move slightly with respect to the attachment members 41 in a state in which the attachment members 41 are inserted through the attachment holes 22.

The first adjustment members 42 are disposed between the outer surface 4A of the formwork 4 and the back surface 20A of the formwork attachment portion 20. The first adjustment members 42 are configured to be inserted into a gap G between the outer surface 4A of the formwork 4 and the back surface 20A of the formwork attachment portion 20. By adjusting the insertion amount of the first adjustment members 42 into the gap G, the first angle, the second angle, and the insertion amount of the anchor support portion 30 with respect to the formwork 4 are adjusted. In the example in FIG. 2, four first adjustment members 42 are disposed, but the number and arrangement positions of the first adjustment members 42 may be appropriately changed according to the first angle, the second angle, and the insertion amount of the anchor support portion 30 with respect to the formwork 4.

As illustrated in FIG. 5, each first adjustment member 42 includes an inclined surface 42A. The inclined surface 42A is inclined such that the thickness of the first adjustment member 42 increases in a direction along the outer surface 4A of the formwork 4.

Each first adjustment member 42 is configured to be tapered toward a distal end. Each first adjustment member 42 includes a base surface 42B opposite to the inclined surface 42A. The inclined surface 42A is inclined toward the distal end so as to approach the base surface 42B. Each first adjustment member 42 is inserted into the gap G such that one of the inclined surface 42A and the base surface 42B is in contact with the outer surface 4A of the formwork 4 and the other of the inclined surface 42A and the base surface 42B is in contact with the back surface 20A of the formwork attachment portion 20. A fixed state of the anchor support 10 with respect to the formwork 4 is stabilized by inserting each first adjustment member 42 into the gap G.

The first adjustment members 42 are, for example, wedges. The first adjustment members 42 are made of, for example, wood, a plastic member, or metal. Multiple the first adjustment members 42 having different thicknesses may be prepared in advance. Alternatively, in a construction site of the foundation 1, the first adjustment members 42 having a desired thickness may be formed by scraping wood with a planer.

As illustrated in FIG. 3, the second adjustment members 43 engage with the adjustment holes 23 provided in the formwork attachment portion 20. The second adjustment members 43 protrude from the back surface 20A of the formwork attachment portion 20 toward the formwork 4. The second adjustment members 43 engage with the adjustment holes 23 of the formwork attachment portion 20 to be able to adjust a protrusion amount PA toward the formwork 4. The second adjustment members 43 are, for example, bolts. The bolts engage with the internal threads of the adjustment holes 23. A distal end of each attachment member 41 is in contact with the outer surface 4A of the formwork 4. Since the second adjustment members 43 are engaged with the adjustment holes 23, as the protrusion amount PA of each second adjustment member 43 increases, portions of the attachment plate-shaped member 21 forming the adjustment holes 23 with which the second adjustment members 43 are engaged move away from the formwork 4. The first angle, the second angle, and the insertion amount of the anchor support portion 30 with respect to the formwork 4 are adjusted by adjusting the protrusion amount PA of each second adjustment member 43.

As illustrated in FIGS. 2 and 3, the adjustment portion 40 includes three second adjustment members 43. The three second adjustment members 43 are disposed in the first adjustment hole 23A, the second adjustment hole 23B, and the third adjustment hole 23C, respectively. The adjustment portion 40 of the present embodiment includes four second adjustment members 43. The four second adjustment members 43 include a first angle adjustment member 43A, a second angle adjustment member 43B, a third angle adjustment member 43C, and a fourth angle adjustment member 43D. The first angle adjustment member 43A is disposed in the first adjustment hole 23A. The second angle adjustment member 43B is disposed in the second adjustment hole 23B. The third angle adjustment member 43C is disposed in the third adjustment hole 23C. The fourth angle adjustment member 43D is disposed in the fourth adjustment hole 23D.

The head of the bolt of each second adjustment member 43 is configured in accordance with, for example, the same standard as the head of the screw of each attachment member 41. A tool for rotating the screw of the attachment members 41 may be the same as a tool for rotating the bolt of the second adjustment members 43. By sharing the tool, the number of tools used in the anchor installation method by the anchor support 10 can be reduced, so that the efficiency of the work of installing the anchors 8 can be improved.

Main Body Support Portion

As illustrated in FIGS. 1 to 3, the anchor support 10 includes the main body support portion 50. The main body support portion 50 is provided on the lower surface 30Y of the anchor support portion 30 so as to support the anchor support portion 30. The main body support portion 50 is disposed on the upper surface 4X of the formwork 4. By disposing the main body support portion 50 on the upper surface 4X of the formwork 4, the main body support portion 50 is configured such that the anchor support 10 can stand by itself on the upper surface 4X of the formwork 4. The main body support portion 50 supports the anchor support portion 30 such that the anchor support portion 30 is located above the foundation 1 so that a worker smooths a surface of the concrete 2 forming the foundation 1.

As illustrated in FIG. 4, the main body support portion 50 includes a first main body support portion 51 and a second main body support portion 52. The first main body support portion 51 and the second main body support portion 52 are provided on the lower surface 30Y of the anchor support portion 30 and are configured to be disposed on the upper surface 4X of the formwork 4. The second main body support portion 52 is disposed away from the first main body support portion 51. Each of the first main body support portion 51 and the second main body support portion 52 is provided at a respective one of both end portions of the lower surface 30Y of the anchor support portion 30 in the extending direction of the formwork 4.

The first main body support portion 51 includes a first support plate-shaped member 53 extending in the vertical direction. The second main body support portion 52 includes a second support plate-shaped member 54 extending in the vertical direction. The first support plate-shaped member 53 and the second support plate-shaped member 54 are formed integrally with the attachment plate-shaped member 21. The first support plate-shaped member 53 and the second support plate-shaped member 54 are formed integrally with the anchor support plate-shaped member 31.

Anchor Installation Method

An anchor installation method will now be described with reference to FIGS. 1, 3 and 6 to 8. The anchor installation method is a method of installing the anchors 8 on the formwork 4 by using the anchor support 10 including the formwork attachment portion 20 and the anchor support portion 30. The anchor installation method is used in the construction of the foundation 1.

As illustrated in FIG. 1, before the anchors 8 are installed in the foundation 1, the ground 6 is provided with a groove 6A. The formwork 4 is installed so as to surround the foundation 1 to be constructed. The formwork 4 is disposed along the groove 6A outside the groove 6A. The reinforcing bars 3 are provided along the groove 6A. The reinforcing bars 3 are disposed on the entire surface of the ground 6 on which the foundation 1 is provided. The anchor support 10 is installed on the foundation 1 after the formwork 4 is installed on the ground 6 and before the concrete 2 is placed.

FIGS. 3 and 6 to 8 are views illustrating the respective steps in the anchor installation method. The anchor installation method includes a first step, a second step, and a third step. In the first step, the formwork attachment portion 20 is attached to the outer surface 4A of the formwork 4 by the attachment members 41 such that the gap G is provided between the outer surface 4A of the formwork 4 and the back surface 20A of the formwork attachment portion 20. In the second step, the first adjustment members 42 are disposed in the gap G. In the third step, by protruding the second adjustment members 43 from the back surface 20A of the formwork attachment portion 20 toward the formwork 4 and adjusting the protrusion amount PA toward the formwork 4, the angle of the anchor support portion 30 with respect to the formwork 4 is adjusted.

The anchor installation method includes a preparation step. The preparation step is performed before the first step. In the preparation step, by disposing the main body support portion 50 of the anchor support 10 on the upper surface 4X of the formwork 4, the anchor support 10 is disposed on the upper surface 4X of the formwork 4. When the anchor support 10 is disposed on the upper surface 4X of the formwork 4, the height of the upper surface 4X of the formwork 4 in the vertical direction is checked. When the anchor support 10 is disposed on the upper surface 4X of the formwork 4, the insertion amount of the anchor support 10 is adjusted such that the anchor attachment portion 33 of the anchor support portion 30 is located substantially above the reference line L.

Figure 6:
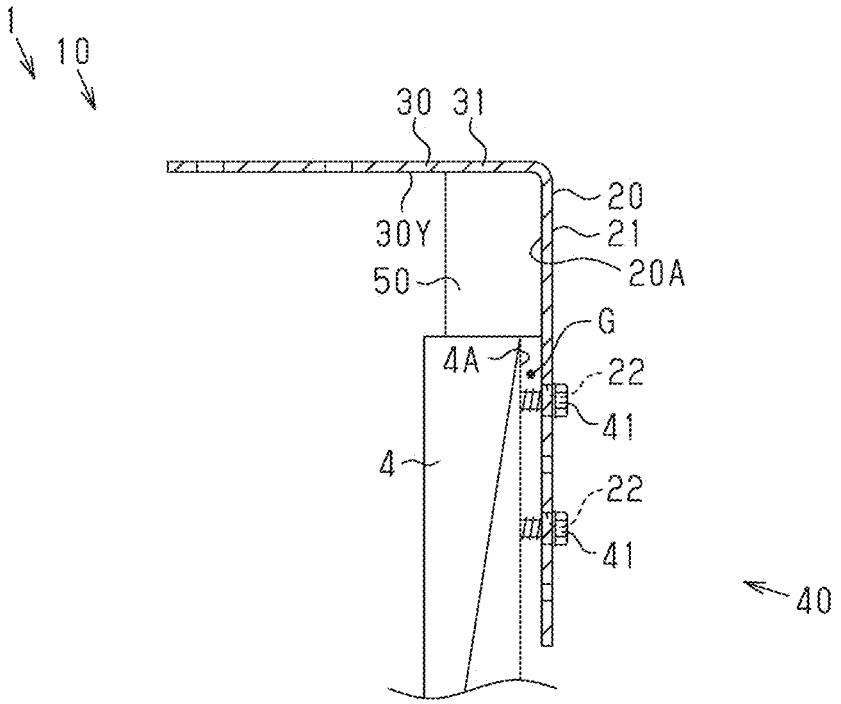
FIG. 6 is a first cross-sectional view of an anchor installation method according to the embodiment.

As illustrated in FIG. 6, in the first step, the formwork attachment portion 20 is attached to the outer surface 4A of the formwork 4 by the attachment members 41 such that the gap G is provided between the outer surface 4A of the formwork 4 and the back surface 20A of the formwork attachment portion 20. The formwork attachment portion 20 is attached to the outer surface 4A of the formwork 4 by inserting the attachment members 41 through the attachment holes 22 and engaging with the formwork 4. Since the attachment members 41 are not engaged with the attachment holes 22, the attachment plate-shaped member 21 can move with respect to the attachment members 41.

Figure 7:
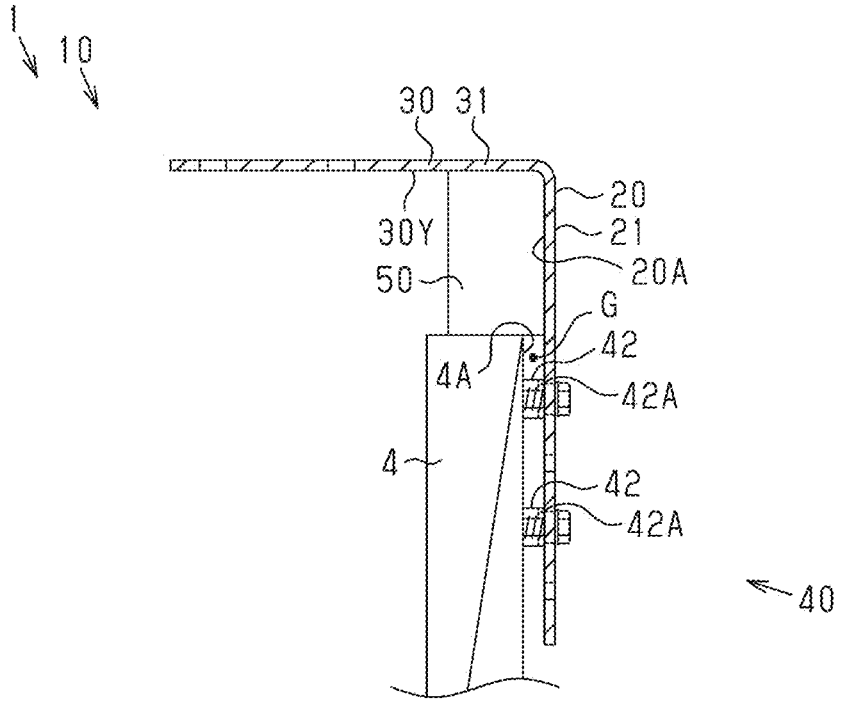
FIG. 7 is a second cross-sectional view of the anchor installation method according to the embodiment.

As illustrated in FIG. 7, in the second step, by disposing the first adjustment members 42 in the gap G, the approximate position of the anchor support 10 with respect to the formwork 4 is determined. In the example in FIG. 7, the first adjustment members 42 are inserted into the gap G from the back side toward the front side of the sheet along the outer surface 4A of the formwork 4. The first adjustment members 42 may be inserted into the gap G from bottom to top along the outer surface 4A of the formwork 4. Since each first adjustment member 42 includes the inclined surface 42A, as the first adjustment member 42 is inserted into the gap G, the attachment plate-shaped member 21 of the formwork attachment portion 20 is pushed to the outside of the foundation 1 from the formwork 4. Since the attachment plate-shaped member 21 of the formwork attachment portion 20 moves from the formwork 4 to the outside of the foundation 1 by the first adjustment member 42, the insertion amount of the anchor support portion 30 with respect to the formwork 4 is adjusted. The first angle and the second angle of the anchor support 10 with respect to the formwork 4 are adjusted by inserting the multiple first adjustment members 42 having different thicknesses into the gap G so as to be aligned along the edge of the attachment plate-shaped member 21.

Figure 8:
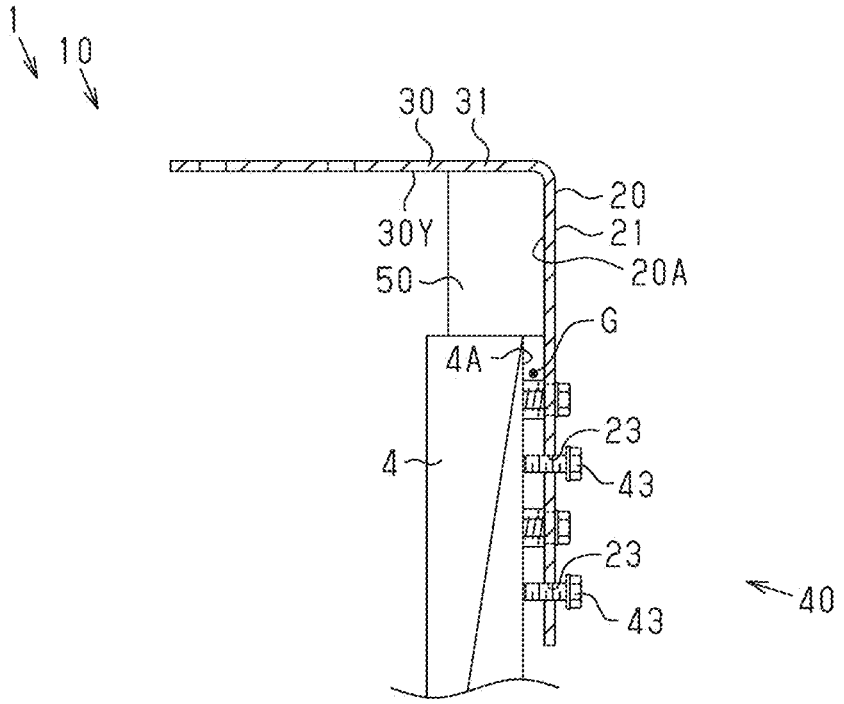
FIG. 8 is a third cross-sectional view of the anchor installation method according to the embodiment.

As illustrated in FIGS. 3, 4, and 8, in the third step, by protruding the second adjustment members 43 from the back surface 20A of the formwork attachment portion 20 toward the formwork 4 and adjusting the protrusion amount PA toward the formwork 4, the angle of the anchor support portion 30 with respect to the formwork 4 is adjusted. In this step, by adjusting the protrusion amount PA of each of the four second adjustment members 43, the first angle and the second angle of the anchor support 10 with respect to the formwork 4 are adjusted. For example, the first angle is adjusted by making the protrusion amounts PA of the first angle adjustment member 43A and the second angle adjustment member 43B larger or smaller than the protrusion amounts PA of the third angle adjustment member 43C and the fourth angle adjustment member 43D. The second angle is adjusted by making the protrusion amounts PA of the first angle adjustment member 43A and the third angle adjustment member 43C larger or smaller than the protrusion amounts PA of the second angle adjustment member 43B and the fourth angle adjustment member 43D. In this step, in order to adjust the first angle and the second angle, a first adjustment member 42 may be additionally disposed in the gap G, or at least one of the first adjustment members 42 may be removed from the gap G. Alternatively, in this step, in order to adjust the first angle and the second angle, a screwed amount of each attachment member 41 into the formwork 4 may be adjusted.

The anchor installation method includes a fourth step. As illustrated in FIG. 3, in the fourth step, the anchors 8 are attached to the anchor attachment portion 33 of the anchor support portion 30. The anchors 8 are fastened to the anchor support plate-shaped member 31 by the nuts 8C.

The anchor installation method includes a fifth step. As illustrated in FIG. 1, after the anchors 8 are disposed in the foundation 1, the concrete 2 is placed in the groove 6A of the ground 6. The upper surface 2X of the concrete 2 is smoothed by a concrete rake or a trowel. On the upper surface 2X of the concrete 2, the portion below the anchor support portion 30 is smoothed using, for example, the trowel.

Operation of Present Embodiment

The operation of the present embodiment will now be described.

By attaching the anchors 8 to the anchor support 10 installed on the formwork 4, the anchors 8 are disposed so as to be along the reference line L. However, it is difficult to install the formwork 4 on the ground 6 so that the formwork 4 is accurately installed along the reference line L. Even when the formwork 4 can be accurately installed, distortion may occur in the frame plate 5 of the formwork 4 due to the influence of climate or the like after the formwork 4 is installed until the anchor support 10 is installed on the formwork 4. Further, when foreign matter such as soil or concrete adheres to the formwork 4, unevenness may be generated on the outer surface 4A of the formwork 4. Due to the unevenness generated on the outer surface 4A of the formwork 4, the anchor support 10 installed on the formwork 4 may be inclined with respect to the reference line L.

The anchor support 10 includes the adjustment portion 40. The formwork attachment portion 20 is attached to the formwork 4 by the attachment members 41 of the adjustment portion 40. The position of the anchor support portion 30 with respect to the formwork 4 can be adjusted by adjusting the insertion amount of each first adjustment member 42 into the gap G and the protrusion amount PA of each second adjustment member 43 after the formwork attachment portion 20 is attached to the formwork 4 by the attachment members 41. The insertion amount of each first adjustment member 42 into the gap G can be adjusted by the operator moving the first adjustment member 42 along the outer surface 4A of the formwork 4 from the edge of the attachment plate-shaped member 21. The protrusion amount PA of each second adjustment member 43 can be adjusted by the operator rotating the bolt of the second adjustment member 43. Since the first angle, the second angle, and the insertion amount of the anchor support 10 with respect to the formwork 4 can be adjusted in this manner, the angle of the anchor support 10 is finely adjusted easily as compared with a case in which the worker directly holds and moves the attachment plate-shaped member 21 or the anchor support plate-shaped member 31. In this manner, the anchor support 10 can be installed on the formwork 4 such that the anchor support 10 is aligned with the reference line L.

Advantages of Present Embodiment

Advantages of the present embodiment will now be described.

(1) The anchor support 10 is an anchor support 10 that supports the anchors 8 provided in the foundation 1. The anchor support 10 includes the formwork attachment portion 20, the anchor support portion 30, and the adjustment portion 40. The formwork attachment portion 20 is attached to the outer surface 4A of the formwork 4 of the foundation 1. The anchor support portion 30 extends from the formwork attachment portion 20 and supports the anchors 8. The adjustment portion 40 adjusts the first angle in the vertical direction or the second angle in the horizontal direction of the anchor support portion 30 with respect to the formwork 4. The formwork attachment portion 20 includes the attachment holes 22 and the adjustment holes 23. The adjustment portion 40 includes the attachment members 41, the first adjustment members 42, and the second adjustment members 43. The attachment members 41 are inserted into the attachment holes 22 of the formwork attachment portion 20 and are engaged with the formwork 4 so as to attach the formwork attachment portion 20 to the outer surface 4A of the formwork 4. The first adjustment members 42 are disposed between the outer surface 4A of the formwork 4 and the back surface 20A of the formwork attachment portion 20. The second adjustment members 43 protrude from the back surface 20A of the formwork attachment portion 20 toward the formwork 4, and engage with the adjustment holes 23 of the formwork attachment portion 20 to be able to adjust the protrusion amount PA toward the formwork 4.

According to this configuration, by adjusting the insertion amount of each first adjustment member 42, the insertion amount of the first adjustment member 42 with respect to the formwork 4 can be adjusted. The first angle and the second angle of the anchor support 10 with respect to the formwork 4 can be adjusted by adjusting the thickness of a portion of each first adjustment member 42 located between the outer surface 4A of the formwork 4 and the back surface 20A of the formwork attachment portion 20. In addition, the first angle and the second angle of the anchor support 10 with respect to the formwork 4 can be adjusted by adjusting the protrusion amount PA of each second adjustment member 43 toward the formwork 4. In this manner, the position of the anchor support 10 with respect to the formwork 4 can be easily adjusted.

In the present embodiment, the attachment members 41 are screws, the first adjustment members 42 are wedges, and the second adjustment members 43 are bolts. Since all the components forming the adjustment portion 40 are easily obtained, the adjustment portion 40 of the anchor support 10 can be easily configured. By keeping the bolts of the second adjustment members 43 engaged with the internal threads of the adjustment holes 23 when the anchor support 10 is not used, the internal threads of the adjustment holes 23 are less likely to be contaminated when the anchor support 10 is stored.

(2) Each first adjustment member 42 includes the inclined surface 42A inclined so as to increase the thickness of the first adjustment member 42 in the direction along the outer surface 4A of the formwork 4. According to this configuration, the thickness of the portion of each first adjustment member 42 disposed between the outer surface 4A of the formwork 4 and the back surface 20A of the formwork attachment portion 20 can be suitably adjusted. The insertion amount of the first adjustment member 42 into the gap G between the outer surface 4A of the formwork 4 and the back surface 20A of the formwork attachment portion 20 can be adjusted by moving each first adjustment member 42 along the outer surface 4A of the formwork 4. Since the inclined surface 42A is formed on each first adjustment member 42, the thickness of the portion disposed between the outer surface 4A and the back surface 20A of the formwork attachment portion 20 can be easily adjusted by adjusting the insertion amount of the first adjustment member 42 into the gap G.

(3) The adjustment holes 23 include the first adjustment hole 23A, the second adjustment hole 23B, and the third adjustment hole 23C. The adjustment portion 40 includes three second adjustment members 43. The three second adjustment members 43 are disposed in the first adjustment hole 23A, the second adjustment hole 23B, and the third adjustment hole 23C, respectively. The first adjustment hole 23A is disposed above the second adjustment hole 23B or the third adjustment hole 23C in the vertical direction. The first adjustment hole 23A is disposed at a position away from the second adjustment hole 23B or the third adjustment hole 23C in the horizontal direction. According to this configuration, the angle of the formwork attachment portion 20 with respect to the formwork 4 can be suitably adjusted by adjusting the protrusion amount PA of each of the three second adjustment members 43. The angle of the anchor support 10 with respect to the formwork 4 can be adjusted by adjusting the angle of the formwork attachment portion 20 with respect to the formwork 4. The first angle and the second angle can be adjusted by adjusting the protrusion amount PA of each second adjustment member 43 disposed in the first adjustment hole 23A and the protrusion amount PA of the second adjustment member 43 disposed in the second adjustment hole 23B or the third adjustment hole 23C. Since the adjustment of the protrusion amount PA of each second adjustment member 43 can be performed by rotating the bolt of the second adjustment member 43, the protrusion amount PA can be easily adjusted.

(4) The anchor support 10 includes the main body support portion 50. The main body support portion 50 is provided on the lower surface 30Y of the anchor support portion 30 so as to support the anchor support portion 30. The main body support portion 50 is disposed on the upper surface 4X of the formwork 4. According to this configuration, since the anchor support portion 30 is supported on the upper surface 4X of the formwork 4 by the main body support portion 50, the anchors 8 are suitably supported with respect to the formwork 4. When the anchor support 10 stands by itself on the upper surface 4X of the formwork 4 by the main body support portion 50, the anchor support 10 can be installed on the formwork 4 in a state in which the anchor support 10 stands by itself. When the worker attaches the formwork attachment portion 20 to the formwork 4 and adjusts the position of the anchor support 10 by the adjustment portion 40, since the anchor support 10 can stand by itself, the worker easily performs the work of installing the anchor support 10.

(5) The formwork attachment portion 20 includes the attachment plate-shaped member 21. The attachment plate-shaped member 21 is disposed so as to extend in the vertical direction along the formwork 4. The anchor support portion 30 includes an anchor support plate-shaped member 31. The anchor support plate-shaped member 31 intersects the attachment plate-shaped member 21. The anchor support plate-shaped member 31 is formed integrally with the attachment plate-shaped member 21. According to this configuration, since the attachment plate-shaped member 21 is formed integrally with the anchor support plate-shaped member 31, the anchor support 10 is easily handled. In the present embodiment, since the formwork attachment portion 20, the anchor support portion 30, and the main body support portion 50 of the anchor support 10 are formed by a single component, the anchor support 10 has a simple configuration. For example, the anchor support 10 can be formed by one metal plate. Therefore, the anchor support 10 is excellent in its productivity. In addition, since the anchor support 10 has a simple configuration, work related to storage, transportation, and arrangement can be performed by a relatively small number of workers.

In a case in which the attachment plate-shaped member 21 is formed separately from the anchor support plate-shaped member 31, foreign matter such as soil or concrete may enter between the attachment plate-shaped member 21 and the anchor support plate-shaped member 31, and thus, the positional accuracy of the anchor support 10 in the formwork 4 may decrease. According to this configuration, since the attachment plate-shaped member 21 is formed integrally with the anchor support plate-shaped member 31, the influence of the foreign matter on the positional accuracy can be suppressed.

(6) The anchor installation method is a method of installing the anchors 8 on the formwork 4 by using the anchor support 10 including the formwork attachment portion 20 and the anchor support portion 30. The anchor support portion 30 supports the anchors 8. The formwork attachment portion 20 is attached to the outer surface 4A of the formwork 4 of the foundation 1. The anchor installation method includes a first step, a second step, and a third step. In the first step, the formwork attachment portion 20 is attached to the outer surface 4A of the formwork 4 by the attachment members 41 such that the gap G is provided between the outer surface 4A of the formwork 4 and the back surface 20A of the formwork attachment portion 20. In the second step, the first adjustment members 42 are disposed in the gap G. In the third step, by protruding the second adjustment members 43 from the back surface 20A of the formwork attachment portion 20 toward the formwork 4 and adjusting the protrusion amount PA toward the formwork 4, the angle of the anchor support portion 30 with respect to the formwork 4 is adjusted. The second adjustment members 43 are engaged with the adjustment holes 23. The adjustment holes 23 are provided in the formwork attachment portion 20. According to this configuration, since the angle of the anchor support 10 with respect to the formwork 4 can be suitably adjusted by the first adjustment members 42 and the second adjustment members 43, the position of the anchor support 10 with respect to the formwork 4 can be easily adjusted.

Modifications

The above embodiments are examples of possible forms of the anchor support 10 and the anchor installation method, and are not intended to limit the form. The anchor support 10 and the anchor installation method can take forms different from the forms exemplified in the above embodiments. One example thereof is a form in which a part of the configuration of the embodiment is replaced, changed, or omitted, or a form in which a new configuration is added to the embodiment. Modifications of the embodiment will now be described below.

The number of attachment holes 22 may be one or three or more. The attachment holes 22 may be disposed at positions away from the center of the attachment plate-shaped member 21 in the horizontal direction. The number and arrangement of the attachment holes 22 may be set according to the shape and weight of the anchor support 10.

As long as the first angle or the second angle of the anchor support portion 30 with respect to the formwork 4 can be adjusted, the number of the adjustment holes 23 may be two, three, or five or more. When the number of the adjustment holes 23 is three, the fourth adjustment hole 23D may be omitted from the adjustment holes 23.

The adjustment portion 40 may be configured to adjust only the first angle. In the present modification, the second adjustment hole 23B and the fourth adjustment hole 23D may be omitted from the adjustment holes 23.

The adjustment portion 40 may be configured to adjust only the second angle. In the present modification, the third adjustment hole 23C and the fourth adjustment hole 23D may be omitted from the adjustment holes 23.

The first adjustment members 42 need not include the inclined surface 42A. The first adjustment members 42 of the present modification are, for example, flat plate-shaped members. The first angle and the second angle of the anchor support 10 with respect to the formwork 4 may be adjusted by the number of the flat plate-shaped members disposed between the outer surface 4A of the formwork 4 and the back surface 20A of the formwork attachment portion 20. In the present modification, by changing the number of the flat plate-shaped members, the thickness of the first adjustment members 42 can be changed.

Figure 9:
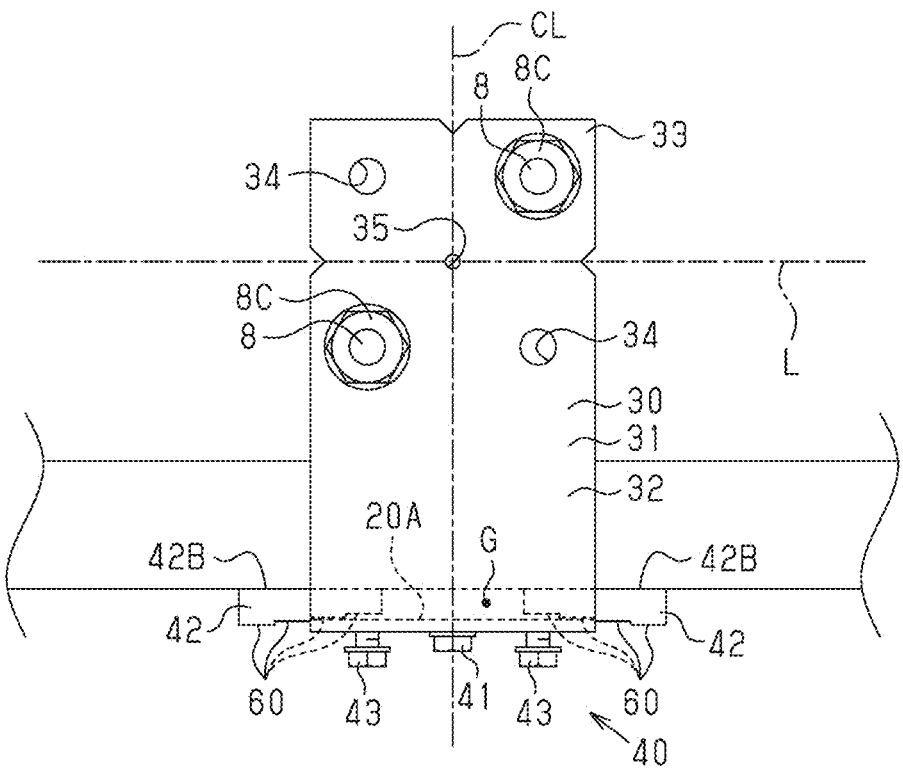
FIG. 9 is a plan view of a state in which the anchor support of a modification is installed on the formwork.

As illustrated in FIG. 9, each first adjustment member 42 may include multiple stepped surfaces 60. In the multiple stepped surfaces 60, the thickness of each first adjustment member 42 increases in the direction along the outer surface 4A of the formwork 4. In the adjustment portion 40, both the first adjustment members 42 including the multiple stepped surfaces 60 and the first adjustment members 42 including the inclined surface 42A may be used.

The main body support portion 50 may be omitted. In the present modification, since the configurations of the first support plate-shaped member 53 and the second support plate-shaped member 54 are omitted, the anchor support 10 can be configured more easily.

The anchor support plate-shaped member 31 may be formed separately from the attachment plate-shaped member 21. The anchor support plate-shaped member 31 of the present modification may be attached to the attachment plate-shaped member 21 by, for example, a bolt or a nut.

The present specification discloses the following techniques.

Clause 1

An anchor support that supports an anchor provided in a foundation, the anchor support comprising:

- a formwork attachment portion attached to an outer surface of a formwork of the foundation;
- an anchor support portion extending from the formwork attachment portion and supporting the anchor; and
- an adjustment portion that adjusts at least one of a first angle in a vertical direction and a second angle in a horizontal direction of the anchor support portion with respect to the formwork, wherein
- the formwork attachment portion includes an attachment hole and an adjustment hole, and
- the adjustment portion includes:
  - an attachment member inserted into the attachment hole of the formwork attachment portion and engaged with the formwork to attach the formwork attachment portion to the outer surface of the formwork;
  - a first adjustment member disposed between the outer surface of the formwork and a back surface of the formwork attachment portion; and
  - a second adjustment member protruding from the back surface of the formwork attachment portion toward the formwork, and engaging with the adjustment hole of the formwork attachment portion to be able to adjust a protrusion amount toward the formwork.

Clause 2

The anchor support according to clause 1, wherein the first adjustment member includes an inclined surface inclined such that a thickness of the first adjustment member increases in a direction along the outer surface of the formwork, or multiple stepped surfaces in which the thickness of the first adjustment member increases in a direction along the outer surface of the formwork.

Clause 3

The anchor support according to clause 1 or 2, wherein

- the adjustment hole includes a first adjustment hole, a second adjustment hole, and a third adjustment hole,
- the adjustment portion includes three second adjustment member disposed in the first adjustment hole, the second adjustment hole, and the third adjustment hole, respectively,
- the first adjustment hole is disposed above the second adjustment hole or the third adjustment hole in the vertical direction, and
- the first adjustment hole is disposed at a position away from the second adjustment hole or the third adjustment hole in the horizontal direction.

Clause 4

The anchor support according to any one of clauses 1 to 3, further comprising a main body support portion provided on a lower surface of the anchor support portion to support the anchor support portion,

- wherein the main body support portion is disposed on an upper surface of the formwork.

Clause 5

The anchor support according to any one of clauses 1 to 4, wherein the formwork attachment portion includes an attachment plate-shaped member disposed to extend in the vertical direction along the formwork, the anchor support portion includes an anchor support plate-shaped member intersecting the attachment plate-shaped member, and the anchor support plate-shaped member is formed integrally with the attachment plate-shaped member.

Clause 6

An anchor installation method of installing an anchor in a formwork by using an anchor support, the anchor support including a formwork attachment portion attached to an outer surface of the formwork of a foundation and an anchor support portion that supports the anchor, the anchor installation method comprising:

a first step of attaching the formwork attachment portion to the outer surface of the formwork by an attachment member such that a gap is provided between the outer surface of the formwork and a back surface of the formwork attachment portion;

a second step of disposing a first adjustment member in the gap; and a third step of adjusting an angle of the anchor support portion with respect to the formwork by protruding a second adjustment member from the back surface of the formwork attachment portion toward the formwork, the second adjustment member being engaged with an adjustment hole provided in the formwork attachment portion, and by adjusting a protrusion amount toward the formwork.

REFERENCE SIGNS LIST

1 Foundation
4 Formwork
8 Anchor
10 Anchor Support
20 Formwork Attachment Portion
21 Attachment Plate-Shaped Member
22 Attachment Hole
23 Adjustment Hole
23A First Adjustment Hole
23B Second Adjustment Hole
23C Third Adjustment Hole
30 Anchor Support Portion
31 Anchor Support Plate-Shaped Member
40 Adjustment Portion
41 Attachment Member
42 First Adjustment Member
42A Inclined Surface
43 Second Adjustment Member
50 Main Body Support Portion
60 Stepped Surface

The invention claimed is:

1. An anchor support that is configured to support an anchor provided in a foundation, the anchor support comprising:

a formwork attachment portion configured to be attached to an outer surface of a formwork of the foundation;

an anchor support portion extending from the formwork attachment portion and supporting the anchor; and an adjustment portion that is configured to adjust at least one of a first angle in a vertical direction and a second angle in a horizontal direction of the anchor support portion with respect to the formwork, wherein the formwork attachment portion includes an attachment hole and an adjustment hole, and the adjustment portion includes:

an attachment member inserted into the attachment hole of the formwork attachment portion and configured to be engaged with the formwork to attach the formwork attachment portion to the outer surface of the formwork;

a first adjustment member disposed between the outer surface of the formwork and a back surface of the formwork attachment portion; and a second adjustment member protruding from the back surface of the formwork attachment portion toward the formwork, and engaging with the adjustment hole of the formwork attachment portion to be able to adjust a protrusion amount toward the formwork.

2. The anchor support according to claim 1, wherein the first adjustment member includes an inclined surface inclined such that a thickness of the first adjustment member increases in a direction along the outer surface of the formwork, or multiple stepped surfaces in which the thickness of the first adjustment member increases in a direction along the outer surface of the formwork.

3. The anchor support according to claim 1, wherein the adjustment hole includes a first adjustment hole, a second adjustment hole, and a third adjustment hole, the adjustment portion includes three second adjustment member disposed in the first adjustment hole, the second adjustment hole, and the third adjustment hole, respectively, the first adjustment hole is disposed above the second adjustment hole or the third adjustment hole in the vertical direction, and the first adjustment hole is disposed at a position away from the second adjustment hole or the third adjustment hole in the horizontal direction.

4. The anchor support according to claim 1, further comprising a main body support portion provided on a lower surface of the anchor support portion to support the anchor support portion, wherein the main body support portion is configured to be disposed on an upper surface of the formwork.

5. The anchor support according to claim 1, wherein the formwork attachment portion includes an attachment plate-shaped member disposed to extend in the vertical direction along the formwork, the anchor support portion includes an anchor support plate-shaped member intersecting the attachment plate-shaped member, and the anchor support plate-shaped member is formed integrally with the attachment plate-shaped member.

6. An anchor installation method of installing an anchor in a formwork by using an anchor support, the anchor support including a formwork attachment portion configured to be attached to an outer surface of the formwork of a foundation and an anchor support portion that supports the anchor, the anchor installation method comprising:

attaching the formwork attachment portion to the outer surface of the formwork by an attachment member such that a gap is provided between the outer surface of the formwork and a back surface of the formwork attachment portion;

disposing a first adjustment member in the gap; and adjusting an angle of the anchor support portion with respect to the formwork by protruding a second adjustment member from the back surface of the formwork attachment portion toward the formwork, the second adjustment member being engaged with an adjustment hole provided in the formwork attachment portion, and by adjusting a protrusion amount toward the formwork.

* * * * *